United States Patent [19]

Diaz-Rivera

[11] Patent Number: 4,955,136

[45] Date of Patent: Sep. 11, 1990

[54] SHAVING APPARATUS

[76] Inventor: Jose E. Diaz-Rivera, Calle Amapola, 75 La Ponderosa, Rio Grande, P.R. 00745

[21] Appl. No.: 261,566

[22] Filed: Oct. 24, 1988

[51] Int. Cl.[5] ..... B26B 21/00

[52] U.S. Cl. ..... 30/32; 30/50; 30/87

[58] Field of Search ..... 30/50, 85, 87, 32

[56] References Cited

U.S. PATENT DOCUMENTS

| | | | |
|---|---|---|---|
| 2,083,172 | 6/1937 | Smith | 30/85 |
| 2,844,870 | 7/1958 | Roces et al. | 30/85 |
| 3,823,471 | 7/1974 | Stone | 30/85 |
| 4,403,412 | 9/1983 | Trotta | 30/50 X |

FOREIGN PATENT DOCUMENTS

| | | | |
|---|---|---|---|
| 495513 | 11/1938 | United Kingdom | 30/85 |

*Primary Examiner*—Douglas D. Watts

*Assistant Examiner*—Willmon Fridie, Jr.

*Attorney, Agent, or Firm*—Ostrolenk, Faber, Gerb & Soffen

[57] ABSTRACT

A shaving apparatus including a handle with a rigid portion for gripping, and a bendable, non-resilient portion which receives a disposable, detachable blade unit. The bendable, non-resilient portion can be bent to a fixed angle to provide a large number of possible handle angles for shaving. Alternatively, a shaving apparatus is provided which forms a twin-edged razor blade assembly from two single- or double-edged blades. The device includes a blade assembly comprising two blades mounted on a step-shaped insert in an offset relationship with a spacer between the blades. The blade assembly is locked in the shaving apparatus between a rotating plate and a shank by either a left or right half cover during use. When not in use, both half covers cover the exposed blades. Either half cover forms a handle with a handle extension slidably received in either half cover in a longitudinal arrangement.

15 Claims, 4 Drawing Sheets

SHAVING APPARATUS

BACKGROUND AND FIELD OF THE INVENTION

The invention relates to shaving devices having an angularly positionable blade unit and shaving devices having twin edge razor blade assemblies.

DESCRIPTION OF THE RELATED PRIOR ART

Shaving devices are known which include bendable portions to angle the razor blade to the shaver handle. For example, U.S. Pat. Nos. 1,015,575 to Meyer and 2,08,172 to Smith disclose razors having bendable handles wherein the angle of the blades can be varied with respect to the longitudinal axis of the handle Also, U.S. Pat. No. 1,187,497 to Canfield discloses a similar structure for use in a dental instrument.

In these patents, however, the bendable section is formed of a coiled spring which is both bendable and resilient. Thus, the angle of the blade with respect to the handle is only temporarily varied, and due to the resilient nature of the connection, the blade moves back to its base position after it has been angularly positioned. Since the blade of the prior art devices does not maintain a fixed angular position as in the present invention, it only has one permanent shaving angle of the blade with respect to the handle It is known to provide a twin edge shaving device with a razor assembly having a step-shaped insert permanently coupled between the two blades For example, U.S. Pat. Nos 3,842,499 to Dorion, Jr. and 3,940,853 to Francis both disclose a twin edge razor with a permanently coupled insert and blades which produces the twin-edge feature. The step-shaped insert and blades are permanently coupled as a single unit for sale as a single unit. If an individual desires to have a twin-edge shaver, they must purchase the entire single unit. These patents do not allow an individual to convert two single- or double-edge razor blades into a twin-edge razor assembly. In contrast, according to the invention, it is possible for a barber or individual shaver to convert two single- or double-edged blades into a twin-edge shaving device simply and easily.

SUMMARY OF THE INVENTION

Accordingly, it is an object of the present invention to provide a shaving apparatus with a blade unit which can be fixed at numerous shaving angles with respect to the longitudinal axis of the handle.

It is also an object of the invention to provide a shaving apparatus which makes it possible for a barber or individual shaver to convert two single- or double-edged blades into a twin-edge razor.

The foregoing and other objectives are achieved by providing, in a first embodiment, a razor having a bendable section which may be bent into a deformed state to provide a barber or individual with a large number of possible handle angles for shaving. Furthermore, this embodiment provides a detachable, disposable blade unit further providing convenience for the user. In a second embodiment, a shaving device is provided which includes a step-shaped insert which laterally offsets two ordinary single- or double-edge razor blades A spacer is located between the blades to vertically space the blades. The insert, razor blades, and spacer are locked in the shaving device by a clamping arrangement comprising a rotatable plate and a shank which are held tightly closed by two half covers. Thus, the invention provides a razor which is easy to use and produces the better shaving result known from the twin-edge razors.

BRIEF DESCRIPTION OF THE DRAWINGS

For the purpose of illustrating the invention, there is shown in the drawing several forms which are presently preferred, it being understood, however, that the invention is not limited to the precise arrangements and instrumentalities shown.

DETAILED DESCRIPTION OF THE INVENTION

Figure 1:
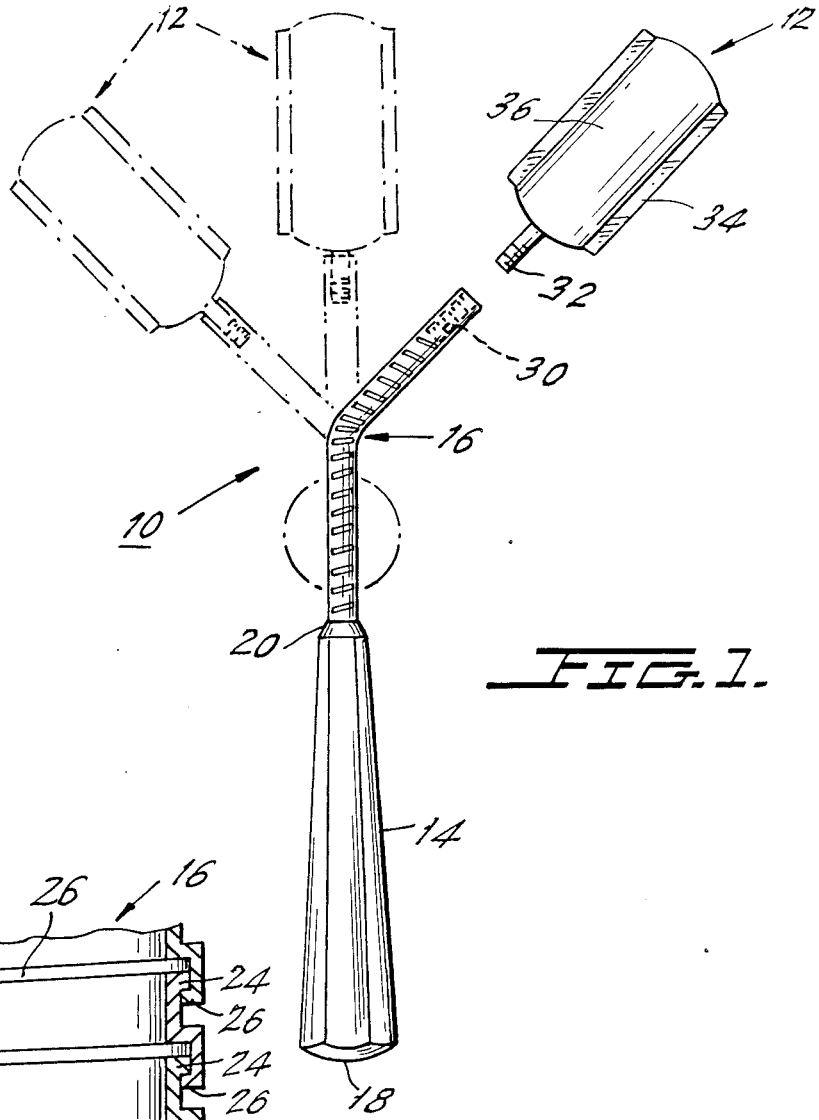
FIG. 1 shows the shaving apparatus of the first embodiment with the blade unit angled with respect to the handle.

Referring now to the drawings wherein like numbers indicate like elements, a shaving device in accordance with the principles of the present invention is shown generally as 10. Shaving device 10 includes a blade unit 12 coupled to a handle 14 via a non-resilient bendable section 16. Handle 14 may be of any suitable shape, but is shown as having a hexagonal cross-section in FIG. 1 to assist the user's grip. To this end, handle 14 may also be tapered in thickness from its distant end 18 up to its neck end 20 which forms a connection with bendable section 16.

Figure 2:
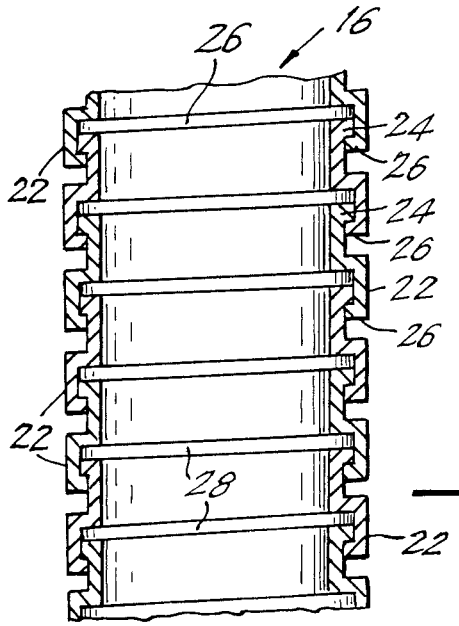
FIG. 2 shows a blow-up cross-section view of the shaving apparatus of FIG. 1 in the region of the phantom circle.

Bendable section 10 is an elongated tubular portion which is integrally formed with the narrowed neck end 20 of handle 14. A better view of bendable section 16 is shown in FIG. 2 which is a blow-up longitudinal cross-section of bendable section 16 taken at the phantom circle of FIG. 1. The bendable section 16 comprises numerous interlocking units 22. Each unit 22 is generally cylindrical in shape and has a S-shaped, cross-sectional wall, as shown in the right cross-sectional cut of FIG. 2. The top of the S provides a lip 24 which grips the bottom 26 of the adjacent unit 27. A space 28 is formed between the inner edges of the respective interlocking units 22 to permit the individual units to be moved angularly with respect to one another. The adjacent units thus interlock in this fashion to provide a tubular, bendable section 16. Section 16 is bendable at any point along its length into an angled position with respect to a longitudinal axis running through the handle 14 of the razor.

According to the invention, section 16 is bendable but non-resilient, i.e., it will stay in the bent position set by the user until it is moved to a different position. As illustrated by way of example in phantom lines in FIG. 1, bendable section 16 can be bent from an upright (longitudinal) position to any desired angular position (positive and negative 45° angle positions being illustrated by way of example) to provide a barber, or an individual shaving himself, with a large number of possible handle angles for shaving. According to the invention, a shaving device 10 is provided which can be bent to shave hard-to-reach areas such as the neck and chin. a shaving device is provided which permits a barber, or individual user, to form a twin-edge blade shaving device out of two single- or double-edge blades.

Figures 3, 8:
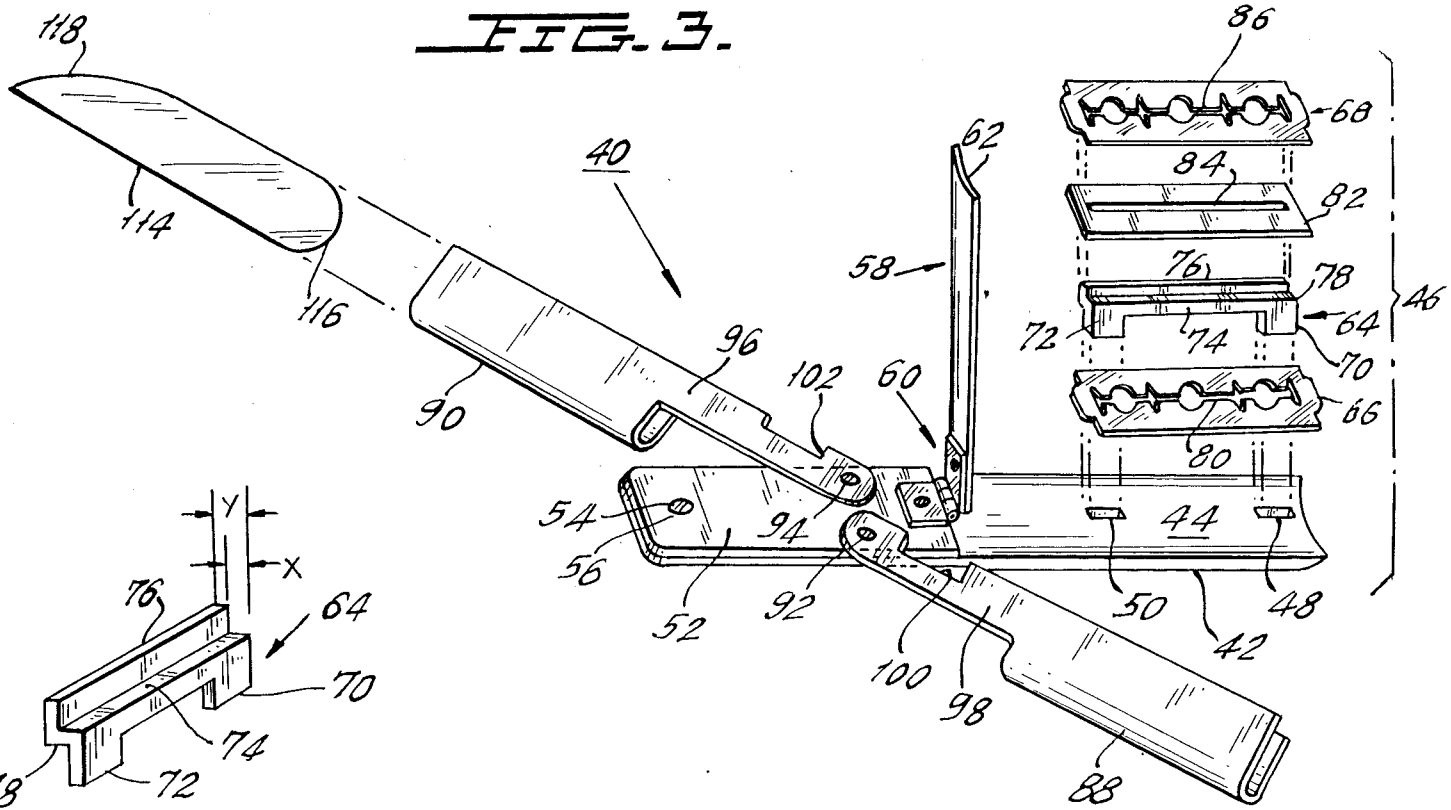
FIG. 3 shows an exploded view of the shaving apparatus according to the second embodiment of the invention.
FIG. 8 is perspective view of a step-shaped insert forming part of the blade assembly of the second embodiment of the invention.

The shaving device of the second embodiment of the invention is shown generally as 40 in FIG. 3. Shaving device 40 has a shank 42 which is generally rectangular and elongated in shape. Shank 42 is beveled to form a concave surface 44 to provide room for a blade assembly 46 which described below. Shank 42 includes an upper region having apertures 48 and 50 and a lower region having a fixed plate 52 mounted thereon. Plate 52 is mounted on the lower region of shank 42 by a screw 54 passing through a threaded aperture 56 in both plate 52 and shrank 42.

A moveable plate 58 is coupled to fixed plate 52 by a hinge 60. Moveable plate 58 has a beveled surface 62 which is concave and is oppositely beveled to beveled surface 44 of shank 42. Plate 58 is movable between an open position as shown in FIG. 3 and a closed position shown in FIG. 7. In the closed position, plate 58 is positioned in close engagement with shank 42. However, due to the oppositely beveled surfaces 44, 62, a space is provided which can accommodate a blade assembly 46 shown in exploded view in FIG. 3.

The heart of blade assembly 46 is a step-shaped insert 64 best shown in FIGS. 3 and 8. Insert 64 enables two standard double edge blades 66, 68 (or alternatively a pair of standard single edge blades) to be converted into a pair of duel edge blades (or alternatively a single duel edge blade). Insert 64 includes two downwardly oriented prongs 70 and 72 received in The blade unit 12 is preferably removably attached to the bendable section 16 by a releasable connector defined by an internally threaded bore 30 formed in the distant end of bendable section 16 and an externally threaded axial projection 32 formed in the bottom end of blade unit 12. Blade unit 12 preferably includes a single double-edged blade 34 whose opposite edges extend from a blade holder 36 which is integrally formed with the projection 32. In the preferred embodiment, the blade holder 36 is a molded plastic unit which is molded around blade 34. The projection 32 is formed integrally with the blade holder 36 during the molding operation. In this manner, the blade unit 12 defines an inexpensive disposable unit which can be removably attached to the bendable section 16, and makes it possible to use the blade unit 12 on a single individual only. This is important for health and safety reasons. While the preferred structure of blade unit 12 has been shown, any blade unit which can be removably, or for that matter permanently, attached to bendable section 16 may be used.

A shaving device constructed in accordance with the principles of a second embodiment of the invention will now be described in conjunction with FIGS. 3-7

It is generally known that twin-edge shaving devices provide a closer shave than the single-edge devices. However, the twin-edge razors are more expensive than the single-edge devices. Thus, it would be advantageous to provide a shaving device which can produce a twin-edge blade arrangement from two single- or double-edge blades. According to the second embodiment, respective apertures 48 and 50 of shank 42. Prongs 70, 72 extend downwardly from a lower blade receiving section 74 which is coupled to an upper blade receiving section 76 by a step section 78. Upper blade receiving section 76 is offset from lower blade receiving section 74 by an offset distance x and, as will be shown, serves to offset the cutting edges of blades 66, 68 by an equal distance x when the blade assembly 46 is fully constructed.

Figure 7:
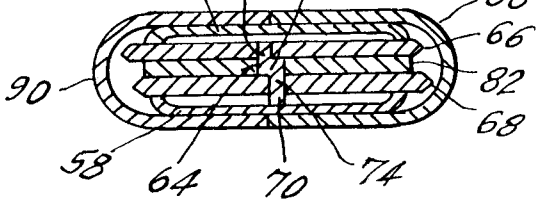
FIG. 7 shows a cross-sectional view along lines 7—7 in FIG. 6.

When the blade assembly 46 is constructed, lower blade receiving section 74 is passed through an irregular aperture 80 formed in lower razor blade 66 (a standard double edge blade) and prongs 70, 72 are slidably received in apertures 48 and 50 of shank 42 as best seen in FIG. 7. Next, a spacer 82 is placed over blade 68 by passing its central slot 84, having a width y equal to the lateral thickness of step section 78, over the step section. Spacer 82, which may have smooth edges as shown in FIG. 3 or may include a saw-tooth edge (not shown), serves to horizontally separate blade 66 from blade 68. While spacer 82 is shown as being separate from insert 64, these two members can be formed in a single unit.

Finally, to blade 68 (a standard double edge blade) is mounted upper blade receiving section 76 by passing section 76 through irregular shaped aperture 86 in razor blade 68. In this manner, a razor blade assembly is produced which forms a pair of twin-edge razors from blades 60 and 68, whose cutting edges are offset in the horizontal direction offset by the lateral distance x and are spaced in the vertical direction by a distance equal to the thickness of spacer 82. This arrangement produces a closer shave than a shaving device using only one blade, but can inexpensively be constructed from two standard single- or double-edged blades. The barber can construct a new blade assembly using a pair of standard single- or double-edged blades for each customer and can throw away the inexpensive single- or double-edged blades after each use. Additionally, to alloy the fears of the public concerning transmittable diseases such as AIDS, the individual coming into the barber shop may bring blades he has purchased personally and hand them to the barber for use in the blade assembly.

The razor blade assembly 46 described above is maintained in shaving device 40 by a clamping arrangement defined by shank 42, moveable plate 58 and a pair of pivotable covers 88, 90. Once blade assembly 46 has been assembled as described above, it is clamped into position by rotating plate 58 about hinge 60 into close engagement with the blade assembly 46 and then pivoting either right half cover 88 or left half cover 90, both of which have a U-shaped cross-section, into the clamping position illustrated in FIG. 6. When the shaving device 40 is being used, only one of the covers 88, 90 will be placed in the clamping position, the remaining cover will be placed in a handle extension position as shown in FIG. 5.

Right cover 88 is pivotally mounted upon shank 42 by a screw 94 passing through internally threaded apertures formed in both shank 42 and fixed plate 52. Any other connector means can be used. The upper side of shafts 96 and 98 have complementary notches 100 and 102, respectively, which together form a cut-out to accommodate hinge 60, as shown in the top view of FIG. 6. The lower side of covers 88, 90 also include notches 104-110 (FIGS. 4 and 5) which receive the ends of prongs 70 and 72 of insert 64 extending through apertures 48 and 50.

Figure 5:
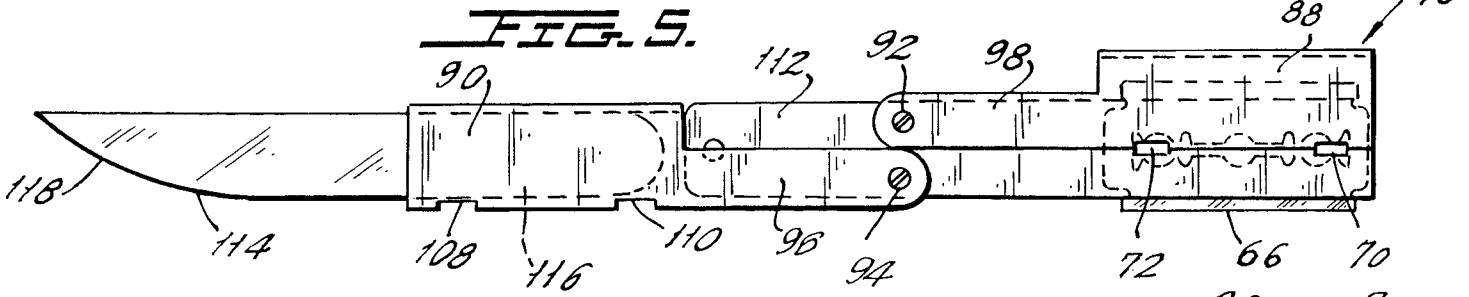
FIG. 5 shows a bottom view of the shaving apparatus according to the second embodiment wherein a blade edge is exposed ready for shaving.

When being used to shave an individual, one of the two covers 88, 90 will be placed in the clamping position illustrated in FIG. 5 so as to clamp the blade assembly 46 together. The remaining cover will be in the handle extension position illustrated by cover 90 in FIG. 5. In this position, the cover 90 and handle section 112 of shank 42 cooperate to define a razor handle to be gripped by the barber. If desired, a further extension piece 114 having a rounded front edge 116 and a tapered rear edge 118 which can slip inside the cover 90 can be provided.

Figure 4:
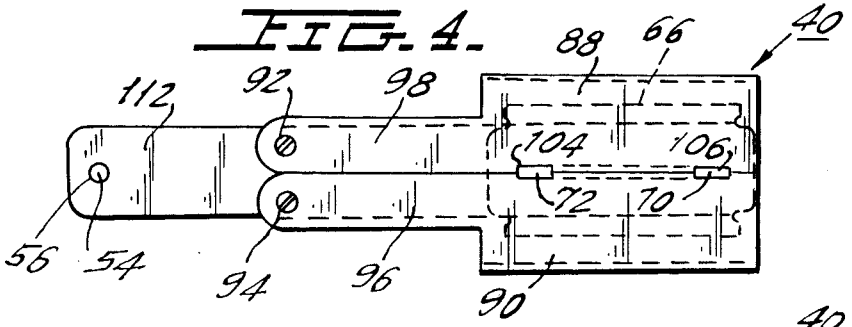
FIG. 4 shoes a bottom view of the closed position of the shaving apparatus according to the second embodiment.
Figure 6:
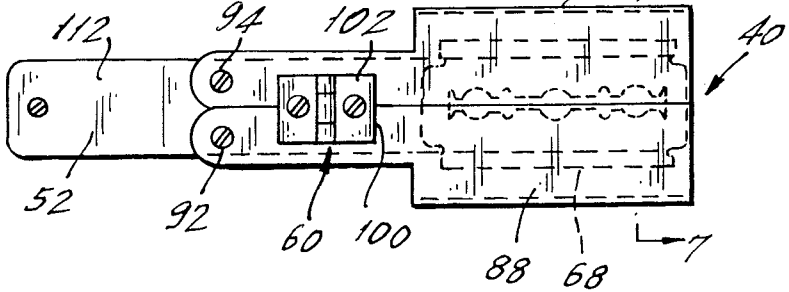
FIG. 6 shows a top view of the shaving apparatus according to the second embodiment.

When the shaving device 40 is not being used, the two cover plates 88, 90 can be pivoted into the clamping position as shown in FIGS. 4, 6 and 7. In this position, the covers 88, 90 will serve as protective covers which house the cutting edges of blades 66, 68 and thereby act as safety covers.

The use of the razor blade assembly as discussed above, enables a barber or individual shaver to make a twin-edge shaver utilizing two standard single- or double-edge blades. Accordingly, the user can avoid purchasing the pre-constructed insert and blade assembly of the prior art and may quickly and easily make a twin-edge razor.

Figure 9:
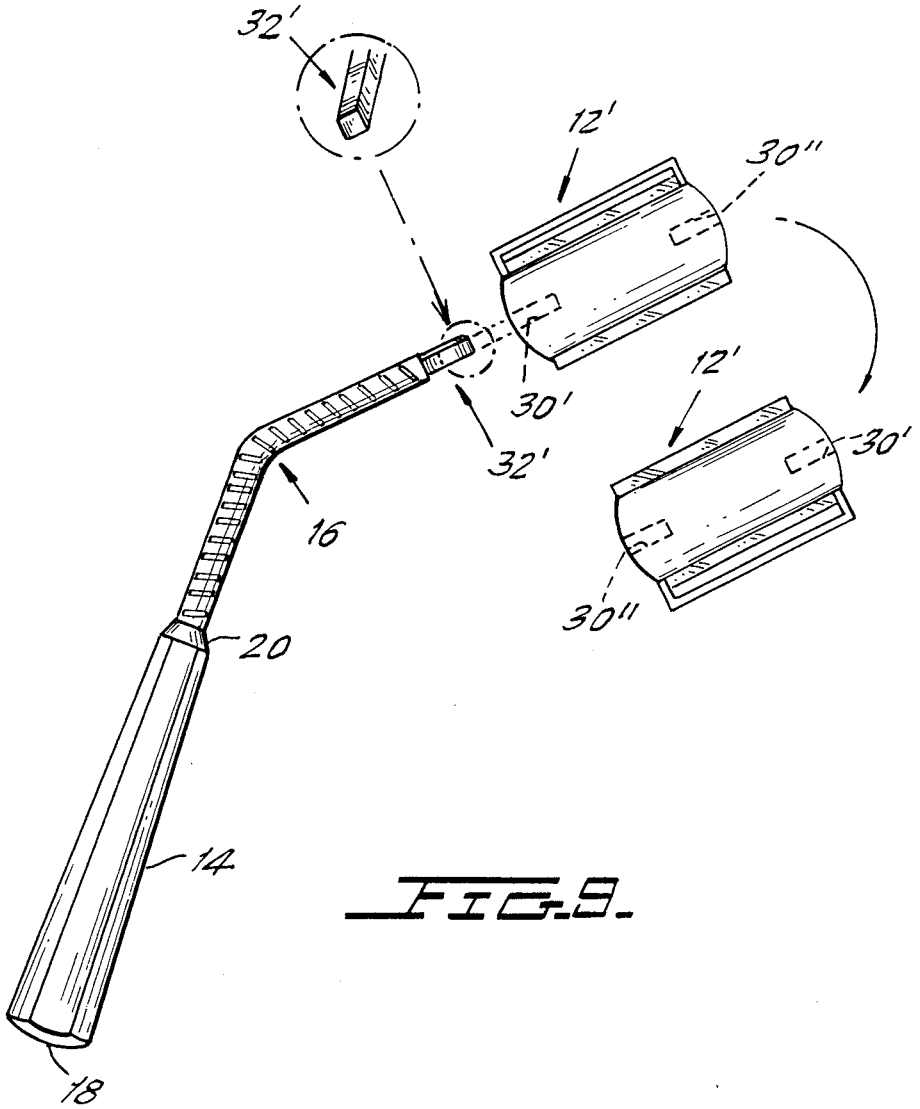
FIG. 9 is a perspective view of a third embodiment which is substantially similar to the first embodiment.

A third embodiment, which is substantially identical to the first embodiment, is illustrated in FIG. 9. In the embodiment illustrated in FIG. 1, the blade unit 12 is connected to the bendable section 14 via an externally threaded projection 32 coupled to the blade unit 12 and an internally threaded bore 30 formed in the distal end of the bendable section 16. In the embodiment illustrated in FIG. 9, the male member of the coupling device is connected to the distal end of the bendable section 16 and a female member of the coupling device is formed as part of the blade unit 12. In the preferred embodiment, the projection 32' coupled to the distal end of the bendable section 16 has a square cross-section which is adapted to be pressure fit into a corresponding square recess 30' and the square recess 30'' formed at opposite longitudinal ends of the blade unit 12'.

The bores 30', 30'' are preferably tapered with the outermost portion of the bore being larger than the innermost portion so as to insure that a snug, but releasable, connection is made when the projection 32' is forced into either of the bores 30', 30''.

In the embodiment illustrated in FIG. 9, the blade unit 12' contains a single dual blade projecting from only side of the blade unit. The dual edge blade will extend either upwardly or downwardly as illustrated in FIG. 9 depending upon which bore 30', 30'' receives the projection 32'. In the embodiments of FIGS. 1 and 9, either blade unit, and indeed any other desired blade unit, can be used.

Although the present invention has been described in connection with a preferred embodiment thereof, many other variations and modifications will now become apparent to those skilled in the art without departing from the scope of the invention. It is preferred, therefore, that the present invention be limited not by the specific disclosure herein, but only by the appended claims.

I claim:

1. A shaving apparatus comprising:

a handle;

a bendable, nonresilient section connected at one end to the handle, said bendable section comprising a plurality of interlocking, circular elements each having an S-shaped cross-sectional wall; and a blade unit connected to another end of the bendable section, the bendable section being bendable by the user of the shaving apparatus to cause the blade unit to be oriented at a desired angle with respect to the handle thereby providing a desired handle angle for the user.

2. A shaving apparatus as claimed in claim 1, further including means for detachably coupling said blade unit to said bendable section.

3. A shaving apparatus as claimed in claimed 2, wherein said coupling means comprises male and female socket members, one of said socket members being formed on said bendable section, the other socket member as being formed on said blade unit.

4. A shaving apparatus as claimed in claim 3, wherein the socket formed on said blade unit is integrally formed with said blade unit.

5. A shaving apparatus as claimed in claim 3, wherein said male and female socket members are formed with externally and internally threaded screws, respectively.

6. A shaving apparatus as claimed in claim 1, wherein said blade unit is a disposable unit.

7. A shaving apparatus as claimed in claim 1, wherein the handle has a hexagonal cross-section.

8. A shaving apparatus as claimed in claim 1, wherein said male and female socket members have a square cross-section and are force fit into one another.

9. A shaving apparatus, comprising:

(A) a handle; and (B) a blade assembly coupled to said handle, said blade assembly comprising:

(1) first and second razor blades each having a cutting edge; and (2) first means for releasably clamping the blades in a shaving orientation wherein the cutting edges are spaced from the offset with respect to one another to form a dual edge blade; said first means comprising:

(a) a stepped insert extending through respective openings in said first and second razor blades for offsetting the razor blades with reference to one another and therefore offsetting the cutting edges with respect to one another;

(b) a spacer member for spacing the first and second razor blades, and therefor for the cutting edges, with respect to one another; and (c) second means for releasably clamping the razor blades, the insert and the spacer member together to maintain the blades and in the shaving orientation.

10. A shaving apparatus according to claim 9, wherein the second means comprises a shank and a cover plate pivotally connected to the shank and movable between an open position wherein the blade assembly may be assembled and disassembled and a closed position wherein the blades are maintained in said shaving orientation and third for releasably maintaining said cover plate in the closed position.

11. A shaving apparatus according to claim 10, wherein the insert includes at least one prong extending into a corresponding slot in the shank for maintaining the insert in a desired orientation relative to the shank.

12. A shaving apparatus according to claim 10, wherein the third means comprises first and second covers pivotally connected to the shank, each of the covers movable between a respective first position wherein it clamps the plate in the closed position, and a second position wherein it acts as an extension of the handle.

13. A shaving apparatus of claim 12, wherein the first and second razor blades each have a pair of cutting edges and wherein the clamping means causes respective cutting edges of each of the razor blades to be spaced from and offset with respect to one another so as to form a pair of double edged blades and wherein the first cover extends over one of the double edged blades when it is in the second position, and the second cover extends over the other duel edged blade when it is in the second position.

14. The apparatus according to claim 12, further including a handle extension removably insertable into that cover member which is located in the first position.

15. The apparatus according to claim 12, wherein the first and second covers are U-shaped in cross section.

* * * * *